US006617803B2

(12) United States Patent
Harris

(10) Patent No.: US 6,617,803 B2
(45) Date of Patent: Sep. 9, 2003

(54) STRING OF ELECTRICALLY POWERED ORNAMENTS

(75) Inventor: Geoffrey Harris, Chicago, IL (US)

(73) Assignee: New England Pottery Co., Inc., Foxboro, MA (US)

( * ) Notice: Subject to any disclaimer, the term of this patent is extended or adjusted under 35 U.S.C. 154(b) by 0 days.

(21) Appl. No.: 09/860,677

(22) Filed: May 18, 2001

(65) Prior Publication Data

US 2002/0171370 A1 Nov. 21, 2002

(51) Int. Cl.[7] ..... H05B 37/00

(52) U.S. Cl. ..... 315/185 R; 315/185 S; 315/179; 362/806; 362/252; 362/227

(58) Field of Search ..... 315/185 S, 185 R, 315/179, 201, 129, 130; 324/133, 414, 508, 512, 528, 537; 362/123, 124, 227, 252, 806

(56) References Cited

U.S. PATENT DOCUMENTS

| | | | | | |
|---|---|---|---|---|---|
| 4,118,762 | A | * | 10/1978 | Fennell | 362/311 |
| 4,173,038 | A | * | 10/1979 | Kiefer | 362/35 |
| 4,939,674 | A | * | 7/1990 | Price et al. | 358/1.9 |
| 5,047,721 | A | * | 9/1991 | Farley | 324/133 |
| 5,317,238 | A | * | 5/1994 | Schaedel | 315/323 |
| 5,319,312 | A | * | 6/1994 | Segilia | 324/133 |
| 5,378,512 | A | * | 1/1995 | Van Wyk | 428/11 |
| 5,454,181 | A | * | 10/1995 | Rothman et al. | 40/564 |
| 5,576,078 | A | * | 11/1996 | Schatz | 428/13 |

* cited by examiner

*Primary Examiner*—Haissa Philogene
(74) *Attorney, Agent, or Firm*—Wolf, Greenfield & Sacks, P.C.

(57) ABSTRACT

A string of electrically powered ornaments such as lights connected in a series and sequentially identifiable indicia is applied sequentially in association with each ornament in the string to enable a person to trace the string for testing each ornament.

20 Claims, 2 Drawing Sheets

STRING OF ELECTRICALLY POWERED ORNAMENTS

FIELD OF THE INVENTION

This invention relates to a string of electrically powered ornaments such as a string of lights used for such purposes as decorating Christmas trees and other symbolic things including commercial branding, showroom displays, etc. More particularly, the invention relates to electrically wired ornament strings and provides means to assist in determining which of the various ornaments in a string has failed. In the following description, the invention is described as it applies particularly to a string of Christmas lights, but it is to be understood that this particular application of the invention is only exemplary of its many uses, and the invention is not to be so narrowly construed except as recited in the appended claims.

BACKGROUND OF THE INVENTION

Light strings frequently are made with fifty or more lights, and when a light fails generally the others remain lit. Occasionally, however, something happens to a bulb that breaks the electrical circuit and all of the lights in the string go out. When that occurs, it is necessary to check each bulb in the string to find the one that failed. When that light is replaced, the entire string will light. Light testers are available to assist in checking all the lights in a string, but it is often difficult to follow the string when it is wound about the branches of a tree and/or used in close proximity with other strings.

A primary object of the present invention is to provide means to assist a person in tracing a light string so that the bulbs may be tested in order without skipping any of the lights in a string or unknowingly retesting any of them.

Another object of the present invention is to assist a person using a light tester so that it may be used most efficiently.

SUMMARY OF THE INVENTION

In accordance with the present invention, the string of ornaments, whether they be lights or other electrically powered elements, are sequentially identified by applying indicia to each ornament in the string such as by numbering or lettering each of the ornaments in sequence. This will enable one to sequentially trace the ornaments in a particular string regardless of how the string is displayed or presented so that each ornament in the string may be tested to identify and replace the failed ornament, to reactivate all of the ornaments in the string.

These and other objects and features of the invention will be better understood and appreciated from the following detailed description of selected embodiments thereof, presented for purposes of illustration and shown in the accompanying drawing.

DETAILED DESCRIPTION

Figure 1:
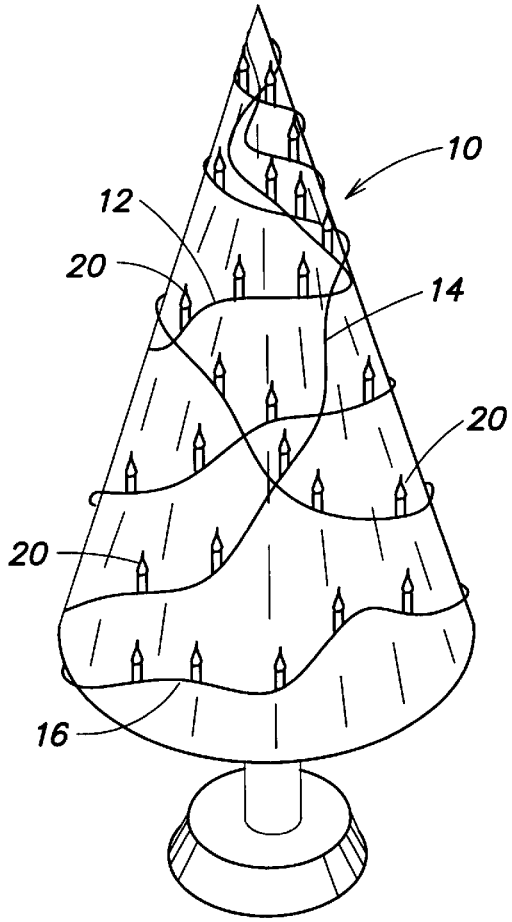
FIG. 1 is a perspective view of a typical Christmas tree illustrating how a number of intertwined or interlaced light strings are typically applied to the tree.
Figure 2:
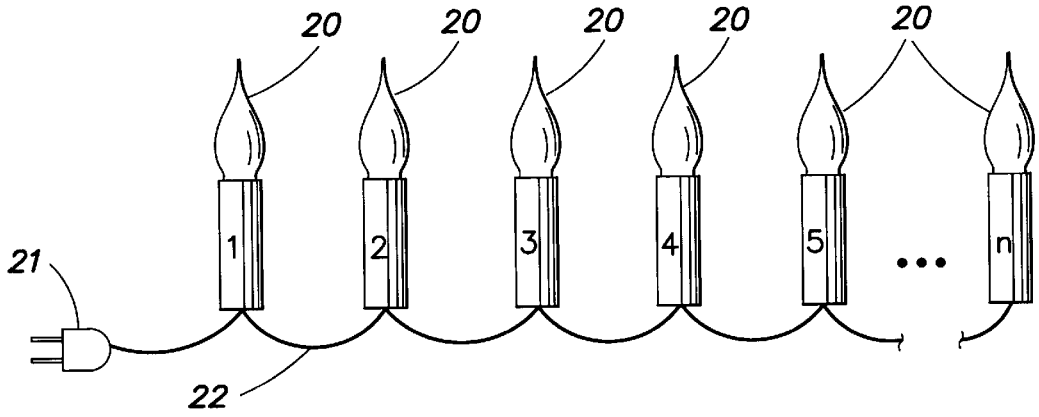
FIG. 2 is a diagrammatic view of a string of lights constructed in accordance with the present invention and sequentially numbered to enable the string to be traced even when wound on a tree in the manner generally suggested in FIG. 1 or in any other location.

In FIG. 1, a Christmas tree 10 is suggested on which are hung a number of string lights 12, 14, 16, . . . , each composed of a substantial number of ornaments 20. As suggested above, while ordinarily the failure of one bulb will not effect the other lights in a string, occasionally the failure of one will cause the entire string to go dark. The single string, 22 suggested in FIG. 2 includes a plug 21 at one end for connecting the string to a power source. The plug is merely representative of a number of different electrical connectors that may be used. It is not uncommon to have fifty or more lights in a single string, and in large displays a single string may have a very large number, even exceeding 100 or more lights.

It is not difficult to appreciate that when all the lights in a string go dark, it is a difficult and time consuming task to locate the failed bulb that caused it, and this task is made more difficult because of the need to trace the string and test the bulbs in sequence. While various sophisticated circuits have been developed that will indicate where failure has occurred and so as to avoid the necessity for tracing along an entire string, they are expensive and not fully reliable.

Figure 3:
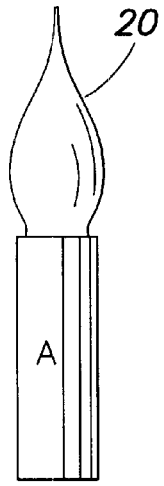
FIG. 3 is an elevation view of a single light including both a socket and lamp carrying indicia, in this case, a letter, so as to enable a series of such lights to be traced to locate a failed bulb so that it may be replaced and thereby render the entire string operative.
Figure 4:
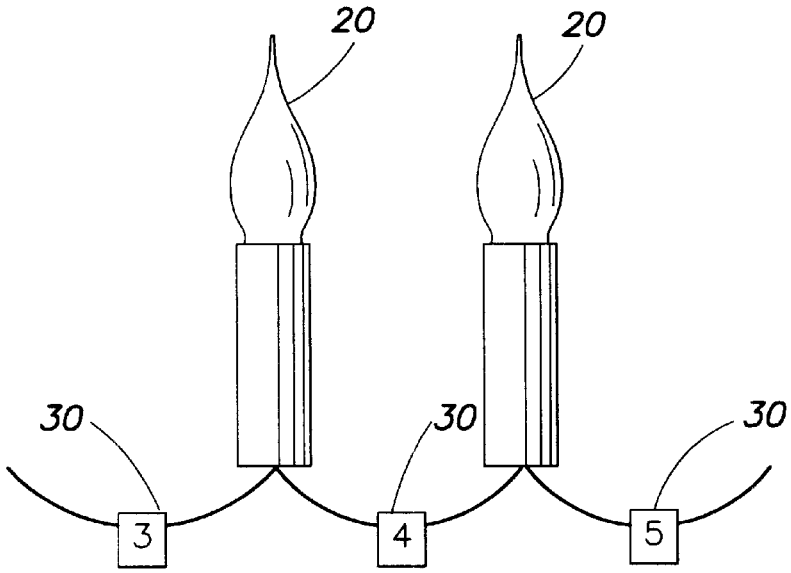
FIG. 4 is a fragmentary elevation view of a string of lights with indicia applied to tags attached to the wires connecting them in the string.

In accordance with the present invention, sequential indicia is associated with each of the lights in a string. Thus, as FIG. 2 suggests 'n' lights in the string, they are consecutively numbered 1-"n". In accordance with one aspect of the invention, the indicia may be applied to the sockets as suggested in FIGS. 2 and 3, but it should be appreciated that the indicia may alternatively be applied to the wiring adjacent each socket by an inconspicuous tag or label 30 wrapped on the wiring as in FIG. 4, or alternatively the wiring itself between adjacent sockets may be sequentially marked so as to assist a person in tracing the string from one end to the other if necessary to locate the failed bulb or other ornament. While in FIG. 2 the indicia is in the form of consecutive numbers applied to the series of lights in sequence, the numbers may be replaced by sequential letters of the alphabet or any other sequential indicia that a person will readily recognize so as to assist him or her to follow the ornaments in series in the string.

While in the foregoing description, the invention has been described as applied to a series of Christmas tree lights in a string, the lights may be replaced by any other electrically powered ornament or device.

While in the foregoing description the lights carry sequential indicia throughout the string, for convenience in manufacturing and to reduce costs, particularly in long strings, an indicia sequence may be repeated. For example in a string of 50 lights, a sequence of 1 through 10 may be repeated five times, or a different sequence may be repeated a sufficient number of times to cover the entire string. In many applications, that arrangement will be adequate to enable a person to trace the string so as to locate the failed light or other ornament.

Having described this invention in detail, those skilled in the art will appreciate that numerous modifications may be made of this invention without departing from its spirit.

Therefore, it is not intended that the breadth of the invention be limited to the specific embodiment illustrated and described. Rather, the breadth of the invention should be determined by the appended claims and their equivalents.

What is claimed is:

1. A string of lights comprising:

a series of light sockets arranged consecutively in the string and comprising first and second light sockets;

wherein the first and second light sockets respectively include first and second indicia that indicate an ordering of the first and second light sockets.

2. A string of lights as defined in claim 1, wherein the first and second light sockets are consecutive sockets in the string.

3. A string of lights as defined in claim 2 wherein the first and second indicia comprise first and second consecutive numbers.

4. A string of lights as defined in claim 2 wherein the first and second indicia comprise first and second consecutive letters.

5. A string of lights as defined in claim 1, wherein the series of light sockets further comprises a third light socket, and wherein the third light socket includes a third indication that indicates an ordering of the third light socket with respect to the first and second light sockets.

6. A string of lights as defined in claim 5, wherein the first, second, and third indicia indicate an ordinal rank of the first, second, and third light sockets within the series of light sockets.

7. A string of ornamental lights comprising:

a series of lights wired as a string of lights and comprising first and second lights;

wherein the first and second lights respectively include first and second indicia that indicate an ordering of the first and second lights.

8. A string of ornamental lights as defined in claim 7 wherein the first and second indicia comprise a series of numbers.

9. A string of ornamental lights as defined in claim 7 wherein the first and second indicia comprise a series of letters.

10. A string of ornamental lights as defined in claim 7, wherein the series of lights further comprises a third light, and wherein the third light includes a third indication that indicates an ordering of the third light with respect to the first and second lights.

11. A string of ornamental lights as defined in claim 10, wherein the first, second, and third indicia indicate an ordinal rank of the first, second, and third lights within the series of lights.

12. A plurality of ornaments electrically wired together as a string and comprising first and second ornaments;

wherein the first and second ornaments respectively include first and second indicia that indicate an ordering of the first and second ornaments.

13. The plurality of ornaments electrically wired together as a string as described in claim 12, wherein the first and second indicia are carried on tags attached to the wire between ornaments.

14. The plurality of ornaments electrically wired together as a string as described in claim 12, wherein first and second indicia are respectively applied to the first and second ornaments.

15. The plurality of ornaments electrically wired together as a string as described in claim 12, wherein the ornaments include sockets and light bulbs.

16. The plurality of ornaments electrically wired together as a string as described in claim 12, wherein the first and second indicia comprise a series of consecutive numbers.

17. The plurality of ornaments electrically wired together as a string as described in claim 12, wherein the first and second indicia comprise a series of consecutive letters.

18. The plurality of ornaments electrically wired together as a string as described in claim 12, wherein the first and second indicia are applied to the wire between the ornaments.

19. The plurality of ornaments electrically wired together as a string as defined in claim 12, wherein the plurality of ornaments further comprises a third ornament, and wherein the third ornament includes a third indication that indicates an ordering of the third ornament with respect to the first and second ornaments.

20. The plurality of ornaments electrically wired together as a string as defined in claim 19, wherein the first, second, and third indicia indicate an ordinal rank of the first, second, and third lights within the plurality of ornaments.

* * * * *